US010480194B1

(12) United States Patent
Szafranski

(10) Patent No.: US 10,480,194 B1
(45) **Date of Patent: *Nov. 19, 2019**

(54) GUTTER COVER

(71) Applicant: David A Szafranski, Avon, OH (US)

(72) Inventor: David A Szafranski, Avon, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/673,673

(22) Filed: Aug. 10, 2017

Related U.S. Application Data

(63) Continuation-in-part of application No. 14/170,570, filed on Feb. 1, 2014, which is a continuation-in-part of application No. 13/506,829, filed on May 18, 2012, now abandoned.

(51) Int. Cl.
*E04D 13/076* (2006.01)

(52) U.S. Cl.
CPC ..... *E04D 13/076* (2013.01)

(58) Field of Classification Search
None
See application file for complete search history.

(56) References Cited

U.S. PATENT DOCUMENTS 2,209,741 A * 7/1940 Sullivan ..... E04D 13/076 210/474
4,592,174 A * 6/1986 Hileman ..... E04D 13/076 210/474
4,841,686 A * 6/1989 Rees ..... E04D 13/076 210/474
5,271,192 A * 12/1993 Nothum, Sr. ..... E04D 13/076 248/48.2
5,595,027 A * 1/1997 Vail ..... E04D 13/076 52/11
6,134,843 A * 10/2000 Tregear ..... E04D 13/076 210/474
6,226,926 B1 * 5/2001 Aritake ..... B60J 10/27 296/146.9
6,349,506 B1 * 2/2002 Pace ..... E04D 13/076 52/11
6,932,911 B1 * 8/2005 Groth ..... E04D 13/076 210/162
7,627,991 B1 * 12/2009 Feldhaus ..... E04D 13/076 210/155
7,740,755 B2 * 6/2010 Wilson ..... E04D 13/076 210/162
8,402,697 B1 * 3/2013 Ealer, Sr. ..... E04D 13/076 52/12
2005/0034376 A1 * 2/2005 Pourdeyhimi ..... E04D 13/076 52/11

(Continued)

*Primary Examiner* — Kyle J. Walraed-Sullivan
(74) *Attorney, Agent, or Firm* — Jerry Semer

(57) ABSTRACT

The gutter cover is placed on top of the gutter and protects the gutter from leaves and debris flowing into the gutter while allowing water to pass into the gutter. The material used to make the gutter cover is a nonwoven fiber material that is a half inch or more in thickness with a width slightly larger than the opening of a gutter. The material allows water to pass easily but will not allow debris and leaves to pass. The material is placed on top of the gutter and deflects leaves and debris over the gutter. As stated above the material's width is slightly larger than the width of the gutter. The installer bends the material and places it on top of the gutter between the fascia board and the lip of the gutter. The material forms a convex surface over the top of the gutter.

9 Claims, 3 Drawing Sheets

(56) References Cited

U.S. PATENT DOCUMENTS

| | | | | |
|---|---|---|---|---|
| 2005/0247611 | A1* | 11/2005 | Groth | E04D 13/076 210/162 |
| 2006/0117672 | A1* | 6/2006 | Kurple | E04D 13/076 52/12 |
| 2007/0277446 | A1* | 12/2007 | Dowling | E04D 13/076 52/11 |
| 2008/0134587 | A1* | 6/2008 | Ealer | E04D 13/076 52/12 |
| 2009/0249704 | A1* | 10/2009 | Wilson | E04D 13/076 52/12 |
| 2011/0126477 | A1* | 6/2011 | Hurn | E04D 13/076 52/12 |
| 2011/0138698 | A1* | 6/2011 | Neumann | E04D 13/076 52/12 |
| 2012/0047818 | A1* | 3/2012 | Lopez | E04D 13/076 52/12 |
| 2012/0151849 | A1* | 6/2012 | Brochu | E04D 3/364 52/12 |
| 2012/0180402 | A1* | 7/2012 | Kalwara | E04D 13/1407 52/58 |
| 2012/0192502 | A1* | 8/2012 | Glander | E04D 13/076 52/12 |
| 2012/0222366 | A1* | 9/2012 | Steinberg | E04D 13/076 52/12 |
| 2013/0145699 | A1* | 6/2013 | Olthoff | E04D 13/076 52/12 |
| 2013/0160377 | A1* | 6/2013 | Sager | E04D 13/076 52/12 |
| 2014/0215929 | A1* | 8/2014 | Lenney | E04D 13/076 52/12 |
| 2014/0223837 | A1* | 8/2014 | Pavlansky | E04D 13/076 52/12 |

* cited by examiner

GUTTER COVER

This application is a continuation in part of prior application Ser. No. 13/506,829 filed May 18, 2012 and application Ser. No. 14/170,570 filed Feb. 1, 2014.

FIELD OF THE INVENTION

This invention relates to an apparatus for preventing leaves and other debris from entering a rain gutter attached to the edge of a roof, and more particularly to a nonwoven fiber material that fits over the top of the rain gutter and prevents leaves and other debris from entering the rain gutter, but allows rain to enter.

BACKGROUND OF THE INVENTION

There is a major problem with roofs. When it rains the water from a large area runs off the side of the roof. This causes the soil next to the home to erode and leads to moisture and water in the basement. To eliminate this problem gutters were invented. The gutter takes the water away from the roof and places it down the drain into a sewage system. This however creates another problem. Not only does the rainwater get in the gutters but also all kinds of debris and leaves. The debris and leave collects at a rate sufficient to clog the gutter and necessitates the cleaning of the gutter. The cleaning of the gutter is a time consuming and arduous job. It also involves climbing a ladder and is many times dangerous.

Numerous systems have been designed to solve this problem. These systems usually consist of a screen, a porous foam or a plate with openings placed over the gutter. The inventor began exploring these systems. The inventor found that most of the systems are very expensive and that there are problems with maintenance such as wasp forming nest in the gutter. The systems designed for the homeowner to instill are very complicated to install. Many of the system must be screwed in place and thus take a large amount of labor to place within the gutters. Others have complicated interlocking systems to lock up on the gutter. They all take numerous hours of work attaching them to the gutter. Most of these systems are expensive to make, difficult to place on the gutters, and difficult to maintain.

One system shown in U.S. Pat. No. 5,956,904 to Gentry shows a system that uses two layers of metal screens to cover the gutter. The support screen is a large mesh expanded metal screen. Large mesh screen is sturdy enough to retain its shape and withstand ordinary loads resulting from wind, rain, snow, and ice, or accumulated debris. The filtering screen is a small mesh fabric screen and has openings which are small enough to block debris, such as pine needles. The support screen must be able to retains its shape and sturdy enough to resist loads resulting from wind, rain, snow, and ice. One screen must be fold over the other screen at the edges. This makes for a high manufacturing cost. In addition, since the screens are metal they cannot be easily cut to fit different sizes of gutters.

One day when the inventor was fixing his roof, he noticed the material used for the roof vent. This material keeps the leaves out and allows air and water to flow through it. It is designed to withstand all types of weather. The inventor went to the hardware store and purchased some of the material. This material is a nonwoven fiber material that is very porous however is also smooth on its surface. The nonwoven fiber material allows water to flow through with little impedance; however, its openings are far too small for a leaves and debris to be caught. The surface is somewhat smooth to larger objects and thus leaves and debris easily flow over its surface. He found that he could cut the material with just a utility knife. The material is easy to install. To install one cuts the material to the proper length and width, and places the material within the gutter. The material is elastically deformed by the installer applying hand pressure to the material and compressing the edges of the material towards one another. The installer than places the material within the gutter and allows it to decompress against the gutter between the fascia board and the lip of the gutter. The material forms a convex surface over the top of the gutter. The installer can install the material in gutter of a whole home in a short time with only one tool, a utility knife to cut the material.

The inventor further tests the new material by placing the material in his gutters. The material stayed in place even in high wind and heavy downpours. The material when left in place during the heavy snows and ice of winter, will still returned to its original shape in spring.

Thus, the objective of this invention is to create a system that effectively keeps debris and leaves out of the average home gutter but is also inexpensive to make, easy to install and even easier to maintain.

To achieve these goals applicant has found a material that not only allows water and rain to flow easily through but also causes leaves and debris to easily wash over. This is an important advantage over other systems that have openings to allow the water flow through. Leaves and other debris get stuck in the openings and these systems must be cleaned. The openings in applicant's nonwoven fiber material are so small that very little debris or leaves are caught. However, they are of sufficient size to allow the water to easily flow.

As stated above, the surface of the fibers is also somewhat smooth which enhances the ability of the debris and the leaves to wash over the nonwoven fiber material. Finally, if over the years there is some buildup of leaves or debris within the nonwoven fiber material, the nonwoven fiber material is easily removed from the gutter, cleaned with the hose, and replaced with a little or no labor.

Another important feature of the material is that the material has sufficient stiffness that when it is deflected it will return to its original shape. The material can be easily placed within the gutter. The material is slightly deflected and placed between the fascia board and the lip of the gutter. The tension caused by the deflection will hold the material in place at the top of the gutter. The material has sufficient resistance to deflection to hold it in place even under high winds and heavy downpours. The material is easy to cut and thus easy to manufacture in the proper width. The material is easy to manufacture and inexpensive.

Applicant system takes no tools and only requires the slight deflection to be placed upon the gutter.

SUMMARY OF THE INVENTION

The article of manufacture is placed within a gutter and protects the gutter from leaves and debris from flowing into the gutter while allowing water to pass into the gutter and into the sewage system. The article manufacture is a nonwoven fiber material made from staple fiber (short) and long fibers. The fibers are tangled in a thick mass. In the preferred embodiment, the thickness is between one half inch and one inch. The nonwoven fiber material has a width slightly larger than the opening of a gutter. The material can be manufactured in long rolls. The material allows water to pass through easily but will not allow debris and leaves to pass through.

The material is placed on top of the gutter and deflects leaves and debris over the gutter. To place the material on the gutter one cuts the proper length of the material from the roll and places the length of material on top of the gutter. As stated above the material's width is slightly larger than the width of the gutter. The installer then bends the material and places it on top of the gutter between the fascia board and the lip of the gutter. The material forms a convex surface over the top of the gutter.

DETAILED DESCRIPTION OF THE INVENTION

Figure 1:
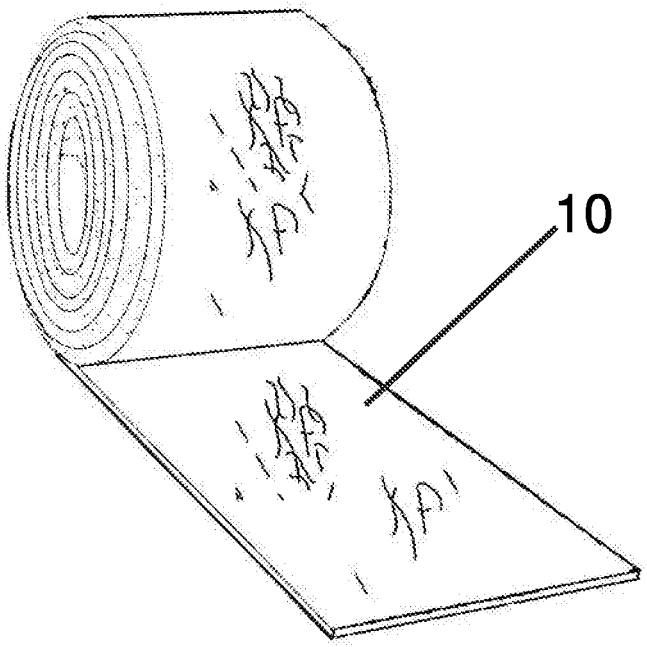
FIG. 1 is a perspective view of the material.

FIG. 1 shows the material 10 that is placed within the gutter 12. In the preferred embodiment, the material is a half inch or thicker and comes in long narrow rolls. The material 10 is a nonwoven fiber material that is presently on the market. The material 10 is made out of fibers of propylene ethylene copolymer or polyester. The nonwoven fiber material is made from staple fiber (short) and long fibers. The fibers are tangled in a thick mass. Water and rain can easily flow through the material 10. However, the material 10 will not allow debris, leaves and other solids to flow through it. The material 10 limits the growth of harmful mold. The material 10 has sufficient stiffness that upon deflection will return to its original shape. In the preferred embodiment, the material 10 is slightly wider than the width of the gutter 12.

Figure 2:
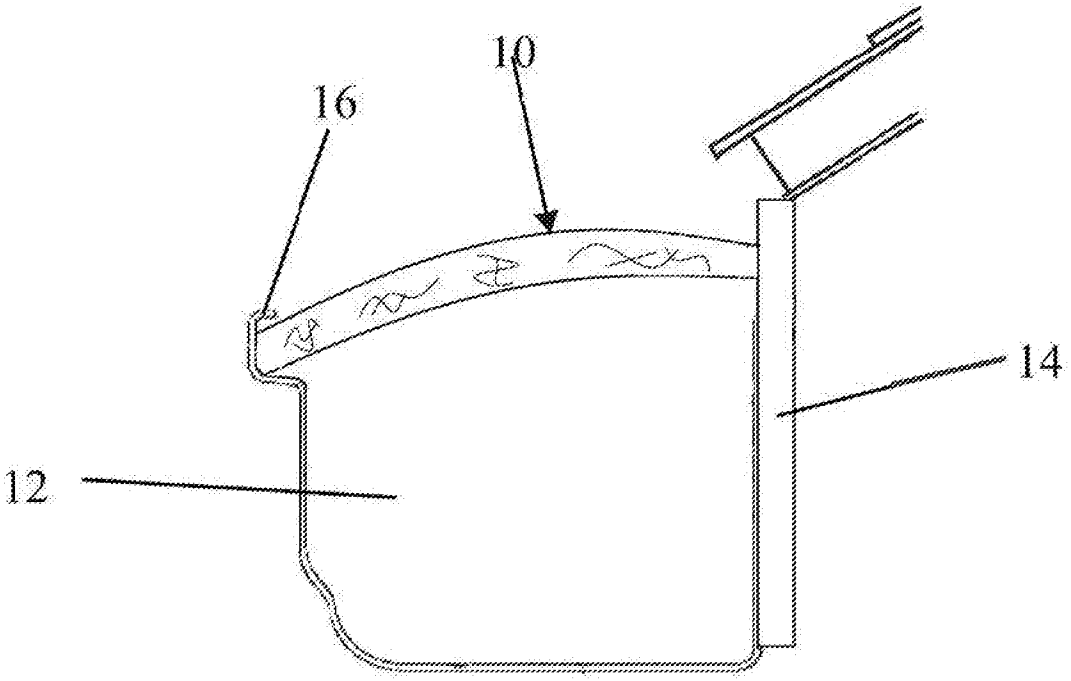
FIG. 2 is a cutaway view of the invention within a gutter upon a home.

The material 10 is placed in the gutter 12 as shown in FIG. 2. The material 10 fits over the top of the gutter 12 between the fascia board 14 and the lip 16 of the gutter 12. Since the material 10 is wider than the width of the gutter 12, to place the material 10 on top of the gutter 12, an individual bends the material and places it in between the fascia board 14 and the lip 16 of the gutter 12. The tension causes the material 10 to spring back to its original shape and holds the material 10 in place on top of the gutter 12. The material 10 forms a convex surface over the top of the gutter 12. The material 10 has sufficient resilience that it will withstand large gust of wind. Snow and ice in the winter will weigh down the material 10, however when the snow and ice melts the material 10 springs back into original position. The material 10 can easily be removed from the gutter 12 if desired by just bending the material and lifting it out of the gutter 12.

In the preferred embodiment, the material 10 will come in a kit. In the kits, the material 10 will either be in a fifty-foot roll or in smaller sections such as sections of four and five feet. To install the fifty-foot section one cuts the material to the proper length and places the material 10 within the gutter. The material can be easily cut with an utility knife. The material is elastically deformed by the installer applying hand pressure to the material 10 and compressing the edges of the material 10 towards one another. The installer than places the material 10 within the gutter and allows material 10 to decompress against the gutter 12 between the fascia board 14 and the lip 16 of the gutter 12.

Figure 3:
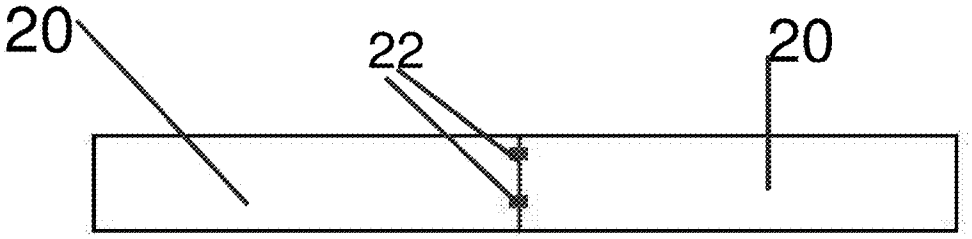
FIG. 3 is a view of two section 20 hooked together with connectors 22.
Figure 4:
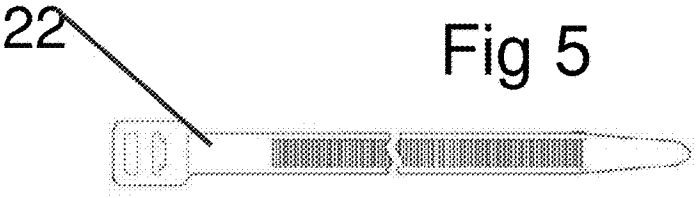
FIG. 4 is a view of connector 22 in the preferred embodiment.

A kit would also be produced with shorter sections of the material 10 for individuals who have trouble spots such as a tree close to the gutter 12. In the preferred embodiment, the sections 20 will be 4 to 5 feet in length. In this embodiment, the sections 20 can be linked together with a connector 22 as shown in FIG. 3. In the preferred embodiment, the connector 22 is a zip tie as shown in FIG. 4. As in the previous embodiment, the material 10 is easy to install. The amount of material 10 is determined and the section 20 are linked together to form the proper length. The material is elastically deformed by the installer applying hand pressure to the material 10 by compressing the edges of the material 10 towards one another. The installer than places the material 10 within the gutter and allows material 10 to decompress against the gutter 12 between the fascia board 14 and the lip 16 of the gutter 12.

Figure 5:
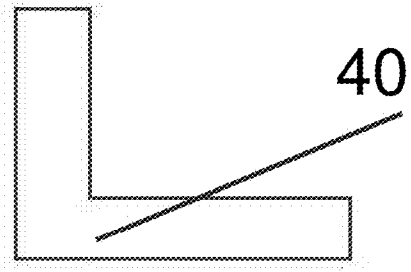
FIG. 5 is a view of corner section 40.

The kit would also contain material 10 that could be placed in a corner of the gutter. The corner section 40 is shown in FIG. 5. Corner section 40 would be placed in gutter that extend around corners.

Changes and modifications in the specifically described in the embodiments can be carried out without departing from the scope of this invention, which is intended to be limited only by the scope of the appending claims.

I claim:

1. A gutter cover that prevents leaves and debris from entering a gutter with an open top and the gutter has a width, has a lip with a back and attaches to a fascia board on a house, consisting of:

a. a single layer fiber material, shaped in an initial flat plane with a width with a first and second edge, that is permeable to water and air but with openings that will not allow debris and leaves to flow through; and, b. said width of the single layer fiber material is wider than a width of the open top of the gutter; and, c. the single layer fiber material in the initial flat plane is installed over over the open top of the gutter, and the first edge is positioned against the back of the lip of the gutter and the second edge is positioned against the fascia board and the single layer fiber material friction and stiffness against the back of the lip of the gutter and the fascia board hold the single layer fiber material in position with no other support or attachment means making contact only with the back of the lip of the gutter and the fascia board forming an arc over the open top of the gutter.

2. A gutter cover that prevents leaves and debris from entering a gutter with an open top and the gutter has a width, has a lip with a back and attaches to a fascia board on a house, as in claim 1 wherein: a. the single layer fiber material is made of fibers of propylene ethylene copolymer.

3. A gutter cover that prevents leaves and debris from entering a gutter with an open top and the gutter has a width, has a lip with a back and attaches to a fascia board on a house, as in claim 1 wherein: a. the single layer fiber material is made of fibers of polyester.

4. A gutter cover that prevents leaves and debris from entering a gutter with an open top and the gutter has a width, has a lip with a back and attaches to a fascia board on a house, as in claim 1 wherein: a. the single layer fiber material is a half inch or thicker.

5. A method for making a gutter cover that prevents leaves and debris from entering a gutter with an open top and the gutter has a width, has a lip with a back and attaches to a fascia board on a house consisting of the steps of:

a) obtaining a piece of single layer fiber material shaped in an initial flat plane that is permeable to water but with openings that will not allow debris and leaves to flow through; and, b) cutting a width of the piece of single layer fiber material to a size that is larger than the width of the gutter and forming the piece of single layer fiber material with a first and second edge; and, c) cutting a length of the piece of single layer fiber material in the initial flat plane to cover the gutter; and, d) placing the piece of single layer fiber material on top of the gutter; and, e) elastically deforming the piece of single layer fiber material; and, f) releasing the piece of single layer fiber material so that the first edge makes contact with the back of the lip of the gutter and the second edge make contact with the fascia board, and the piece of single layer fiber material stiffness against the back of the lip of the gutter and the fascia board holds the piece of single layer fiber material in position without any other support or attachment means, making contact only with the back of the lip of the gutter and the fascia board.

6. A gutter cover that prevents leaves and debris from entering a gutter with an open top and the gutter has a width, has a lip with a back and attaches to a fascia board on a house, as in claim 1 wherein: a. the single layer fiber material is cut with a utility knife.

7. A method for making a gutter cover that prevents leaves and debris from entering a gutter with an open top and the gutter has a width, has a lip with a back and attaches to a fascia board on a house, as in claim 5 wherein:

a. the single layer fiber material is made of fibers of propylene ethylene copolymer.

8. A method for making a gutter cover that prevents leaves and debris from entering a gutter with an open top and the gutter has a width, has a lip with a back and attaches to a fascia board on a house, as in claim 5 wherein:

a. the single layer fiber material is made of fibers of polyester.

9. A method for making a gutter cover that prevents leaves and debris from entering a gutter with an open top and the gutter has a width, has a lip with a back and attaches to a fascia board on a house, as in claim 5 wherein:

a. the single layer fiber material is a half inch or thicker.

* * * * *